US005716253A

United States Patent [19]

Aoki et al.

[11] Patent Number: 5,716,253

[45] Date of Patent: Feb. 10, 1998

[54] THERMALLY COLOR-CHANGEABLE TOY

[75] Inventors: Tadashi Aoki; Tsutomu Tomatsu; Kyoji Aoyama; Naomasa Miyashita; Tsutomu Kito, all of Aichi, Japan

[73] Assignee: The Pilot Ink Co., Ltd., Nagoya, Japan

[21] Appl. No.: 664,179

[22] Filed: Jun. 14, 1996

[30] Foreign Application Priority Data

Jun. 16, 1995 [JP] Japan ..... 7-174387

[51] Int. Cl.[6] ..... A63H 33/30

[52] U.S. Cl. ..... 446/14; 446/481

[58] Field of Search ..... 446/14, 480, 481

[56] References Cited

FOREIGN PATENT DOCUMENTS 382241 8/1990 European Pat. Off. .
1-53075 11/1989 Japan .
4/80594 7/1992 Japan .
2205255 12/1988 United Kingdom .

*Primary Examiner*—William H. Grieb
*Attorney, Agent, or Firm*—Sughrue, Mion, Zinn, Macpeak & Seas, PLLC

[57] ABSTRACT

The present invention provides a thermally color-changeable toy constituted by a thermally color-changeable article, and a color-changing device in which the color-changeable article is stored in a air cooling chamber so that the color of the thermally color-changeable article is thermally changed by cool air. The color-changing device is constituted by a cooling source chamber for storing therein a plurality of piled up cool blocks, the air Cooling chamber communicating with the cooling source chamber so as to circulate air, and an air blower disposed in a communication path between the cooling source chamber and the air cooling chamber. Air flow gaps are formed among the cool blocks so as to improve the cooling efficiency.

11 Claims, 9 Drawing Sheets

THERMALLY COLOR-CHANGEABLE TOY

BACKGROUND OF THE INVENTION

1. Field of the Invention

The present invention relates to a thermally color-changeable toy. Particularly, the present invention relates to a thermally color-changeable toy constituted by a thermally color-changeable article, and an air-cooling color-changing device in which the thermally color-changeable article is stored therein and the color of the thermally color-changeable article is changed by cool air.

2. Description of the Related Art

Conventionally, in order to solve problems (trouble of wetting, etc.) when a thermally color-changeable article is contacted directly by cool water or ice pieces at the time of color-changing the thermally color-changeable article, Unexamined Japanese Utility Model Publication No. Hei-4-80594 discloses an air cooling color-changing device of a thermally color-changeable toy for air-cooling and color-changing a thermally color-changeable toy (corresponding to a thermally color-changeable article of the present invention). The device has a cool generating portion and an air cooling chamber disposed on the top of the cool generating portion for receiving cool air generated in the cool generating portion. The cool air generating portion has a vessel for storing ice pieces, a motor-driven blowing fan for blowing air into the vessel, and exhaust holes disposed in a top plate of the vessel. The air cooling chamber is constituted by the top plate as its bottom so as to communicate with the vessel through the exhaust holes, and has a suction hole for an inlet to the motor-driven blowing fan, so that the vessel portion and the air cooling chamber communicate with each other so as to circulate air.

However, the conventional color-changing device disclosed in Unexamined Japanese Utility Model Publication No. Hei-4-80594 has a problem to be solved as follows.

The cool generating portion is a so-called horizontal vessel where the exhaust holes and a suction hole are provided in the top portion, ice pieces are arranged horizontally in the inside, and air flows horizontally in the inside. Because the ice pieces stored in the cool generating portion contact with the bottom of the cool generating portion, a space (upper space) extending horizontally is formed above the ice pieces in the cool generating portion. Accordingly, the air is apt to pass through the upper space almost straightly with no resistance. Therefore, the contact area between the surfaces of the ice pieces and the flowing air is decreased to reduce the cooling efficiency. Particularly, when the ice pieces begin to melt as time passes, the content of the cool generating portion becomes a mixture of ice existing in the upper portion and water existing in the lower portion. Accordingly, the air flows in the upper space in the cool generating portion while contacting with only the upper surfaces of the ice pieces. As a result, the contact between the ice pieces and the air becomes insufficient so that the cooling efficiency is further reduced.

Examined Japanese Patent Publication No. Hei-1-53075 discloses "A cooking toy constituted by an imitation food and an imitation kitchen utensil wherein the imitation food has its surface to which a predetermined coloration or pattern is given with a temperature-sensitive color-changeable pigment which changes its color at a low temperature, and the imitation kitchen utensil in which a low-temperature article is stored so as to be detachably in contact with the imitation food." In this configuration, however, the color of the thermally color-changeable article (imitation food) is changed only at a portion thereof contacting with the low-temperature article, and it is impossible to change the color over the entire thermally color-changeable article. That is, it is possible to apply this art to only such a toy of a thermally color-changeable article which has a comparatively plane shape, and there is a limit in degree of freedom in selecting the shape of the toy. Particularly, it is not suitable to apply the art to a thermally color-changeable article which has rough surface or is a nonplanar cubic. In addition, if the low-temperature article and the thermally color-changeable article are in contact with each other, the contact portion (color-changed portion) cannot be seen because it is hidden by the low-temperature article. Accordingly, a user has an unmanageable long time from start to completion of the color changing. That is, the user cannot enjoy the process of the color changing.

SUMMARY OF THE INVENTION

In order to solve the foregoing conventional problems, it is an object of the present invention to provide a thermally color-changeable toy having a color changing device in which the cooling efficiency is improved and color-changing of a thermally color-changeable article is effected in a short time. It is another object of the present invention to provide a thermally color-changeable toy in which a user can enjoy the visual change in the process of color changing without feeling that time is being wasted waiting for the color changing process to finish.

A thermally color-changeable toy according to the present invention is comprised of: a thermally color-changeable article, at least part of a surface of said article being changed by cool air; and a color-changing device for changing a color of said thermally color-changeable article, said color-changing device comprising: a cooling source chamber for storing a plurality of cool blocks; an air cooling chamber for storing said thermally color-changeable article, said air cooling chamber communicating with said cooling source chamber to circulate cool air; and an air blower for blowing cool air, said air blower being disposed in a communication path between said cooling source chamber and said air cooling chamber; wherein said cool blocks are stored in a piled-up state in said cooling source chamber so that air flow gaps are formed among said cool blocks.

In the present invention, the cool blocks are stored in the piled-up state in the cool source chamber, and the air flow gaps are formed among the cool blocks. Accordingly, there is no useless space reducing the cooling efficiency in the cool source chamber like in the conventional case. Therefore, it is possible to fill the air flow space with the cool blocks effectively. As a result, the contact area of the flowing air with the cool blocks is increased to further improve the cooling efficiency. Particularly, when the cool blocks are stored in the cool source chamber in the state where they are piled up at random, the air flow gaps are bent to form complicated air flow paths to thereby further improve the cooling performance.

Figure 1:
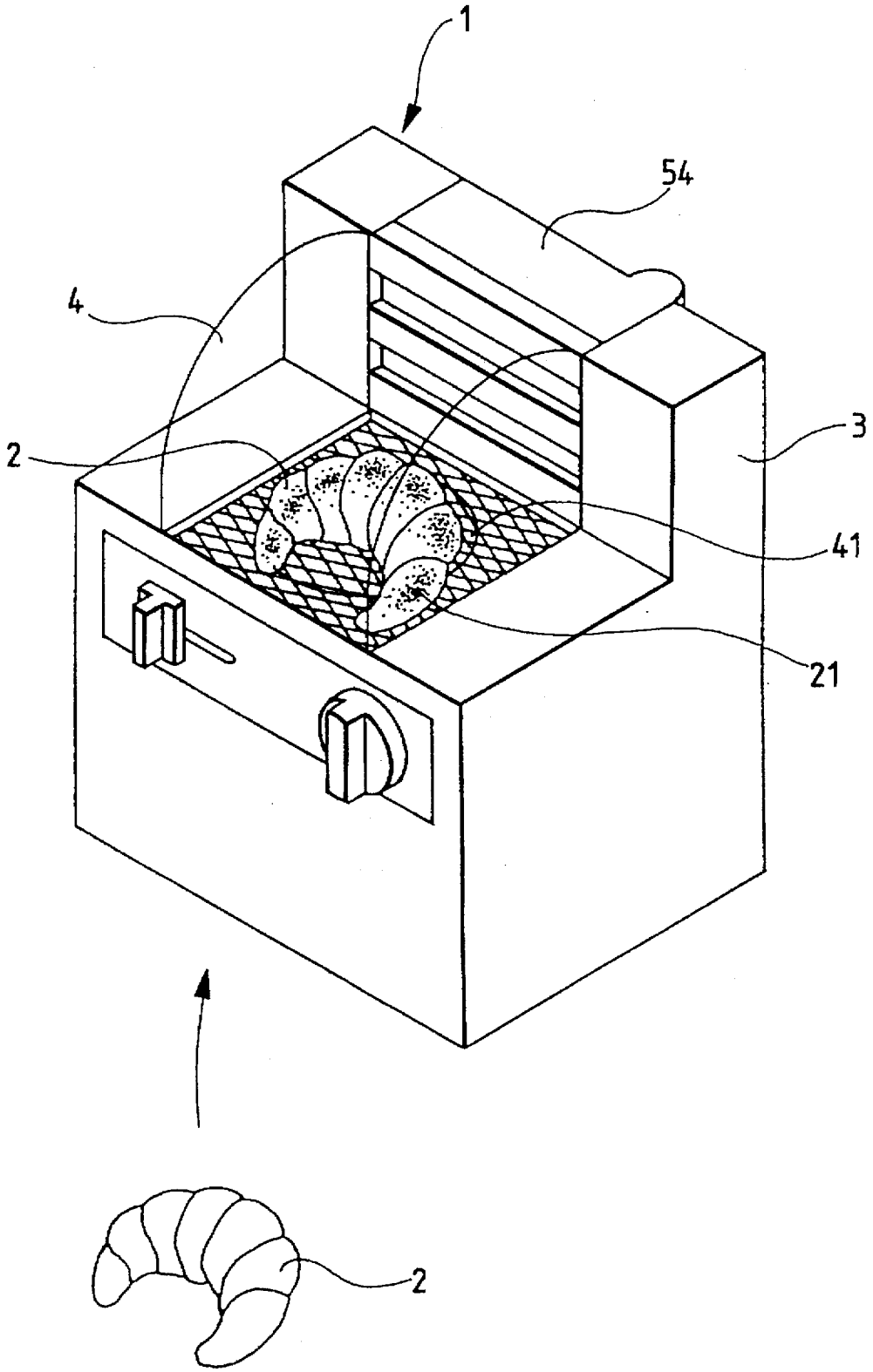
FIG. 1 is a perspective view of a first embodiment of the present invention.

(The arrow "→" in a color changing device indicates the flow of air.)

DETAILED DESCRIPTION OF THE INVENTION

The present invention provides a thermally color-changeable toy comprising a thermally color-changeable article, and a color-changing device 3 in which the thermally color-changeable article 2 is stored in an air cooling chamber 4 so that the color of the thermally color-changeable article 2 is thermally changed by cool air. The color-changing device is constituted by a cool source chamber for storing therein a plurality of cool blocks, the cool source chamber communicating with the air cooling chamber 4 so as to circulate air, and an air blower 7 disposed in a communication path between the cool source chamber and the air cooling chamber, the cool blocks 9 being stored in a piled-up state in the cool source chamber so that air flow gaps are formed among the cool blocks.

In the present invention, preferably, a first communication hole is provided in upper portion of the cool source chamber while a second communication hole is provided in lower portion of the cool source chamber so that the cool source chamber and the air cooling chamber 4 are communicated with each other through the first and second communication holes so as to circulate air, the air being made flow upward or downward in the cool source chamber.

In the present invention, since the air is made to flow vertically in the cool source chamber, the contact area of the air with the cool blocks is increased. Accordingly, the air flowing in the cool source chamber can be cooled efficiently. As a result, it is possible to obtain cool air which is sufficient to change, in a short time, the color of the thermally color-changeable article with any shape.

Further, in the present invention, a liquid collecting portion communicating with the cool source chamber is provided under the second communication holes 52. Accordingly, water drops flowing down from the cool blocks (for example, melted water drops in the case of ice blocks, and water drops due to dew in the case of cool-accumulation blocks) are collected and held in the liquid collecting portion. In addition, the liquid collecting portion is disposed under the communication holes, so that there is no liquid (water drops) in the air flow space between the first and second communication holes of the cool source chamber, and it is possible to maintain the air flow space through the air flow gaps of the cool blocks which due in a solid state to make it possible to maintain superior cooling efficiency for a long time.

Additionally, in the present invention, there is provided a see-through portion for seeing the inside of the air cooling chamber from the outside, so that it is possible to see the process of color changing of the thermally color-changeable article 2 easily to improve visual interest. Consequently, a user does not have any wasted time while waiting for the color changing to be completed, but the user's eyes are attracted by the thermally color-changeable article. In addition, particularly in a system where cool air is poured from above to the thermally color-changeable article in a mount portion 41, the thermally color-changeable article is color-changed from its upper portion, so that it is possible for the user to observe the process of color changing of the thermally color-changeable article in the air cooling chamber more easily.

Preferably, as the see-through portion 43, either a portion of the wall portion or the entire wall portion of the air cooling chamber 4 is formed by a transparent plate of the case. Alternatively, the see-through portion 43 may be formed as an opening portion which is designed so that cool air cannot leak out of the opening portion by means of an air curtain system.

Moreover, in the present invention, it is preferable that the volume A of the cool source chamber is selected to be not less than 1/20 of the volume B of air circulation space other than the cool source chamber 5. Consequently, it is possible to obtain cool air enough to change the color of the thermally color-changeable article.

The effective rate (the value of "A/B") of the volume A of the cool source chamber 5 to the volume B of air circulation space other than the cool source chamber 5 is preferably selected to be not less than 1/10 (relation: $A/B \geqq 0.1$), more preferably, not less than 1/5 (relation: $A/B \geqq 0.2$). The larger the value of "A/B", the more the cooling performance is improved. However, when the volume A and the volume B satisfy at least the relation "$A/B \geqq 0.05$", it is possible to obtain cool air enough to change the color of the thermally color-changeable article 2 rapidly, so that it is possible to form a color-changing device superior in cooling performance.

The thermally color-changeable article has an appearance like an imitation toy, for example, food (foodstuffs, dishes, etc.), dolls (including figurative toys imitating animals, fictitious characters and so on, stuffed toys, etc.), transport toys (cars, airplanes, ships, trains, etc.), accessories (rings, ear-rings, pierces, necklaces, bracelets, hair ornaments, etc.), doll clothes (dresses, hats, shoes, etc.), artificial flowers, etc.

The thermally color-changeable article 2 has a thermally color-changeable portion 21 colored with a color material including a thermally color-changeable material and provided on its surfaces.

As the aforementioned thermally color-changeable material, it is effective to use a reversible thermally color-changeable material having a color-changing point (coloring point) at a temperature not higher than room temperature (for example, 5° C.–20° C., preferably, 10° C.–20° C). For example, it is preferable to use a thermally color changeable material containing a chemical compound containing an electron donative organic compound, a developer for the electron donative organic compound, and an organic compound medium for reversibly causing the coloring reaction of the electron donative organic compound and the developer; microcapsules containing the above components; or a reversible thermally color-changeable material of fine particle resin solid solution.

In addition, as the thermally color-changeable material, it is possible to effectively use a material having a large hysteresis characteristic in accordance with temperature changes, showing interchangeability between a colored state and a colorless state or between a colored state [1] and a colored state [2], and not only changing coloration in its surface in accordance with temperature change, but also having such two-sidedness that either one of both states after and before the change can be selected desirably and kept at room temperature.

As the thermally color-changeable portion, a configuration in which it has a thermally color-changeable layer provided on its surface by application or any other means, a configuration in which it is made of synthetic resin mixed with a thermally color-changeable material, etc. can be listed. The thermally color-changeable portion may be colored with desired coloration and pattern suitably.

As the cool block, examples thereof may include ice lumps, metal lumps, cool-accumulation blocks (having a configuration in which a cool-accumulation medium is sealed up within a thin casing; also called freezing medium blocks), and so on. The shape of the cool block may be spherical, conical, pyramidic, cubic, rectangular, annular, or the like. The metal lumps and the cool-accumulation blocks are cooled in a refrigerator or the like in advance in practical use. In addition, the ice lumps are preferable from the point where they can be obtained easily domestically. In addition, the cool-accumulation blocks and the metal lumps are preferable from the point where they can be used repeatedly without leakage of liquid.

As the air blower, examples thereof may include fans (such as axial fans, centrifugal fans, silocco fans, etc.), air compressors, air pumps, and so on. Although an motor-driven motor is effective as a driving source of the air blower, any other mechanism operated manually may be used.

When the toy shape of the thermally color-changeable article and the toy shape of the color changing device are related to each other, a user can enjoy more interesting play.

Examples of the relation of the shapes of the thermally color-changing article and the color changing device, may be as follows: (a) a combination where the thermally color-changeable article is shaped into a dish, food, or the like, and the color changing device is shaped into a kitchen appliance such as an oven, a microwave oven, a cooking range, or the like; (b) a combination where the thermally color-changeable article is shaped into a car, and the color changing device is shaped into a garage, a painting factory or a car washer; (c) a combination where the thermally color-changeable article is shaped into a doll, and the color changing device is shaped into a fitting room, a shower stall or a dressing room; (d) a combination where the thermally color-changeable article is shaped into an accessory such as a ring, a necklace or the like, and the color changing device is shaped into a jewel case; (e) a combination where the thermally color-changeable article is shaped into an animal toy such as a stuffed toy or the like, and the color changing device is shaped into a pen for the animal; (f) a combination where the thermally color-changeable article is shaped into a sheet of paper or the like, and the color changing device is shaped into a printer; (g) a combination where the thermally color-changeable article is shaped into a plant such as a tree, a flower, a fruit, a vegetable or the like, and the color changing device is shaped into a greenhouse; (h) a combination where the thermally color-changeable article is shaped into a clothing such as a dress or the like, and the color changing device is shaped into a clothing case, a chest or a washer; (i) a combination where the thermally color-changeable article is shaped into an ice cake such as an ice cream, an ice candy or the like, and the color changing device is shaped into a refrigerator; and so on.

Preferred embodiments of the present invention will be described with reference to the drawings as follows.

(Embodiment 1)

Figure 2:
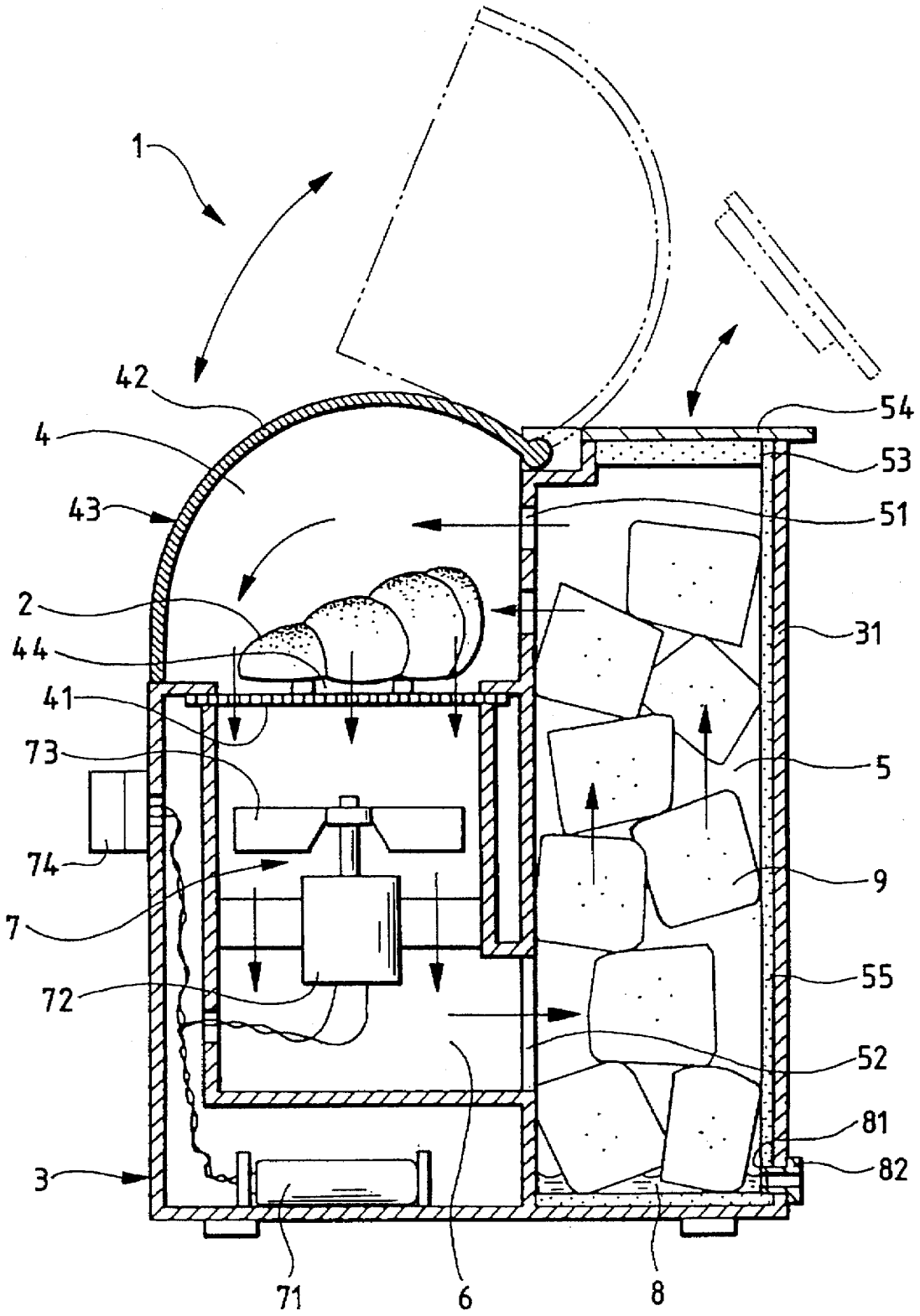
FIG. 2 is a vertical sectional view of FIG. 1.

First embodiment according to the present invention will be described with reference to FIGS. 1 and 2.

In the drawings, reference numeral 1 represents a thermally color-changeable toy. A thermally color-changeable article 2 is produced through blow molding with synthetic resin, and has an appearance of imitating food. Specifically, it has a shape imitating a croissant (crescent-shaped small bread). Other than a croissant, examples of such food may include hamburg steaks, fried prawns, doughnuts, toasts, cookies, cakes, etc. Further, dishes such as gratin, etc. may be listed.

In this embodiment, a thermally color-changeable portion 21 is provided on the surface of the thermally color-changeable article 2 which is shaped into a croissant. The thermally color-changeable portion 21 is white before cooling, but, when cooled, changes its color gradually from white to beautiful brown (in detail, white→light yellow→beautiful brown→dark beautiful brown). The white expresses dough of bread, and the beautiful brown (light brown) expresses the color of baked bread.

A color changing device 3 is formed so that its appearance imitates an oven which is a kitchen utensil. The color changing device 3 is constituted by a front portion which has an air cooling chamber 4 and an air blower 7, and a back portion which has a cooling source chamber 5. The air-cooling chamber 4 and the cooling source chamber 5 are made to communicate with each other so that air can be circulated as shown in FIG. 2.

The cooling source chamber 5 is rectangular, and provided in its top portion with an opening portion 53 for putting-in/taking-out cool blocks 9, for example, ice lumps, and the opening portion 53 is provided with a detachable cover 54. In addition, a heat insulating material 55 made of a porous article or the like is disposed on the inner surface of the cooling source chamber 5 so as to maintain the low-temperature state in the cooling source chamber 5 to thereby keep the cool blocks 9, in a solid state as long as possible. In this embodiment, a plurality of the cool blocks 9 are stored in the state where they are piled up at random while contacting with each other. Consequently, an air flow space in the cooling source chamber 5 can be filled with the cool blocks 9 effectively, so that it is possible to form an air flow space having a complex and complicated flow path to increase the contact area between air and the cool blocks 9, that is, an air flow space high in cooling efficiency. Since the cooling source chamber 5 is not of a horizontal type as in a conventional example, but is a vertical type so that the cool blocks 9 are stored in the state where they are piled up, the cool blocks 9 are kept in contact with each other by gravity in the cooling source chamber 5 so that the cool blocks 9 do not begin to melt easily. Even if the cool blocks 9 begin to melt, they are kept in contact with each other by gravity.

In addition, in the side wall of the cooling source chamber 5, first communication holes 51 are provided in its upper portion, and a second communication hole(s) 52 is/are provided in its lower portion. The communication holes 51 in the upper portion communicate with the side wall of the air-cooling chamber 4, and the communication holes 52 in the lower portion communicate with the bottom wall of the air cooling chamber 4 through a communication path 6.

The communication holes 52 of the cooling source chamber 5 are provided in a position above the bottom surface of the cooling source chamber 5, and the space between the communication holes 52 and the bottom surface of the cooling source chamber 5 (that is, the bottom portion of the cooling source chamber 5) is made to be a liquid collecting portion 8. Since the liquid collecting portion 8 reserves water drops flowing down from the cool blocks 9, the cool blocks 9 can be kept solid in the air flow space between the communication holes 52 and 51 of the cooling source chamber 5. Accordingly, it is possible to keep superior cooling efficiency for a long time. In addition, an exhaust port 81 communicating with the outside is provided in the liquid collecting portion 8. After use, the water drops are discharged from the exhaust port 81. In use, a stopper 82 is attached to the exhaust port 81.

The air cooling chamber 4 is constituted by a transparent case 42 of synthetic resin (such as acrylic resin or the like), a side wall having the communication holes 51, and a bottom surface which acts as a mount portion 41. The case 42 is constituted by a curved surface and two flat surfaces on its sides, and has two opening portions which intersect each other perpendicularly. The two opening portions are closed by the side and bottom walls of the air cooling chamber 4 respectively. The case 42 is supported rotatably by a hinge provided on the top of the cooling source chamber 5 so as to be openable/closable for putting-in/taking-out the thermally color-changeable article 2.

Since the case 42 is disposed at the upper corner of a body 31 of the color changing device 3, the inside of the transparent case 42 (that is, the air cooling chamber 4) can be seen easily from any of the four directions, that is, from the top, from the front, from the right and from the left. The case 42 is formed as a see-through portion 43. The curved portion of the case 42 makes it easier for one to see the inside of the air cooling chamber 4 from the front. In addition, the curved portion makes the flow of air in the air cooling chamber 4 smooth so as to make the horizontal cool air from the communication holes 51 change in its direction of flow rapidly to thereby downwardly contact with the thermally color-changeable article 2 on the mount portion 41. That is, the cooling efficiency of the air in the color changing device 3 is improved by increasing the speed of air circulation.

A net member of metal is disposed on the bottom of the air cooling chamber 4 to form the mount portion 41 having a plurality of holes. In addition, a plurality of projections are provided on the surface of the mount portion 41 to form a gap 44 between the thermally color-changeable article 2 and the mount portion 41. Consequently, the thermally color-changeable article 2 is prevented from closing the holes of the mount portion 41 to make the air flow in the mount portion 41 smooth.

The communication path 6 is an air flow space which makes the mount portion 41 on the bottom of the air cooling chamber 4 communicate with the communication hole 52 in the lower portion of the cooling source chamber 5. An air blower 7 is provided inside the communication path 6.

A motor-driven fan is used herein as the air blower 7. Specifically, the motor-driven fan is constituted by a DC motor 72 connected to a DC power supply 71 (battery), and a rotary fan 73 fixed to an output shaft of the DC motor (so-called axial fan). Then, when a switch 74 is turned on, the rotary fan 73 is driven. Besides such an axial fan, a silocco fan (centrifugal fan), etc. may be used as the motor-driven fan. With the operation of the motor-driven fan (rotations of the fan 73 and the motor 72), the air in the body 31 is circulated as indicated by arrows in FIG. 2, in the order from the communication path 6 (the air blower 7)→the communication holes 52→the cooling source chamber 5→the communication holes 51→the air cooling chamber 4→the mount portion 41→the communication path 6. In addition, the sound generated in the operation of the motor-driven fan can give a user a real sense as if an oven is operated.

Further, in this embodiment, since the volume A of the cooling source chamber 5 is not less than 1/20 of the volume B of the air circulation space except the cooling source chamber 5 (the sum of the volumes of the air cooling chamber 4 and the communication path 6) (that is, $A/B \geqq 0.05$), it is possible to obtain sufficiently cooled air for changing the thermally color-changeable article 2 rapidly. Thus, it is possible to form a color changing device superior in cooling performance.

(Embodiment 2)

Figure 3:
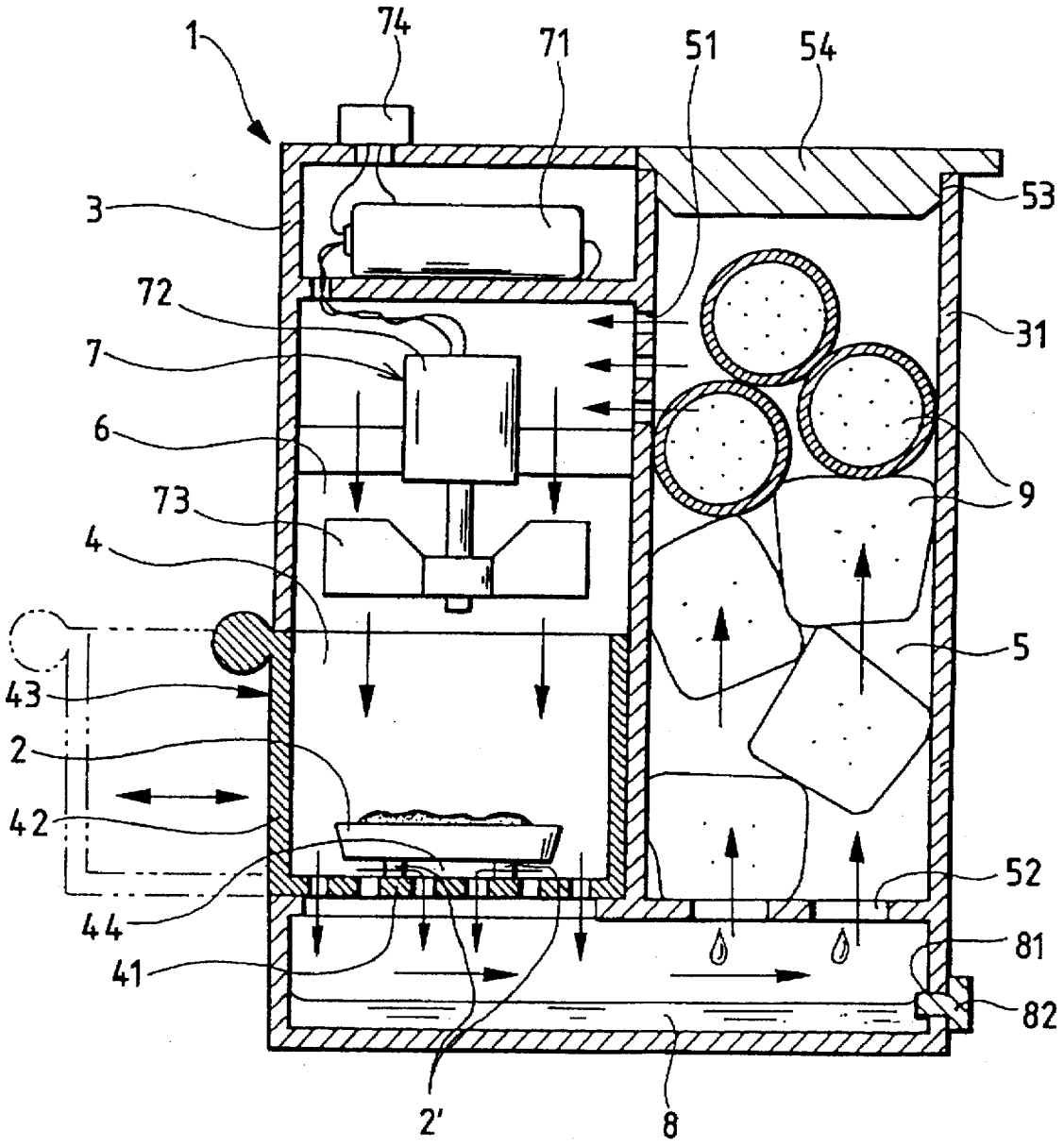
FIG. 3 is a vertical sectional view of a second embodiment of the present invention.

A second embodiment according to the present invention will be described with reference to FIG. 3.

In the drawings, reference numeral 1 represents a thermally color-changeable toy. A color changing device 3 has an appearance like a microwave oven of a cooking utensil or a refrigerator. A thermally color-changeable article 2 has a shape imitating a dish and food on the dish (such as, gratin, stew, curry or the like). In addition, a plurality of projections 2' (leg portions) are provided under the bottom of the dish portion of the thermally color-changeable article 2. Consequently, a gap 44 is formed between the thermally color-changeable article 2 and the top surface of a mount portion 41. Communication holes of the mount portion 41 are opened effectively so as not to be closed by the thermally color-changeable article 2 to thereby reduce the resistance of air flow through the mount portion 41.

In the color changing device 3, an air cooling chamber 4 and an air blower 7 are provided in the front portion, and a cooling source chamber 5 is provided in the rear portion. The air cooling chamber 4 and the cooling source chamber 5 communicate with each other so that air can be circulated.

In the same manner as in the first embodiment, the cooling source chamber 5 is rectangular, and provided in its top portion with an opening portion 53 for putting-in/taking-out cool blocks 9, and the opening portion 53 is provided with a detachable cover 54. In this embodiment, a plurality of approximately cubic ice lumps and a plurality of ball-like cool-accumulation blocks are used as the cool blocks 9, and these lumps and blocks are stored so as to be piled up at random while contacting with each other. The cool-accumulation blocks have a structure where a liquid cool-accumulation such as water or the like is sealed up in a casing of synthetic resin.

In the cooling source chamber 5, communication holes 51 are provided in the upper portion of the side, and communication holes 52 are provided in the bottom. The communication holes 51 make the cooling source chamber 5 communicate with a communication path 6, and the upper portion of the air cooling chamber 4 and the cooling source chamber 5 communicate with each other through the communication path 6. The communication holes 52 make the cooling source chamber 5 communicate with a liquid collecting portion 8, and the mount portion 41 of the bottom portion of the air cooling chamber 4 and the cooling source chamber 5 communicate with each other through the liquid collecting portion 8.

The communication holes 52 are formed to be smaller than the size of any of the cool blocks 9 stored, so that the cool blocks 9 in the cooling source chamber 5 is held above the liquid collecting portion 8 without dropping down into the liquid collecting portion 8. Accordingly, the cool blocks 9 in the cooling source chamber 5 can be used from their lower end effectively and economically to thereby increase the efficiency in air cooling.

The liquid collecting portion 8 is disposed under the mount portion 41 of the air cooling chamber 4 and under the communication holes 52 of the cooling source chamber 5. In addition, the liquid collecting portion 8 is provided with opening portions for communicating with the air cooling chamber 4, and the communication holes 52 for communicating with the cooling source chamber 5. Therefore, the liquid collecting portion 8 not only stores water drops falling down from the cool blocks 9, but also functions as an air flow space for making the cooling source chamber 5 communicate with the mount portion 41 of the air cooling chamber 4.

The air cooling chamber 4 is constituted by a case 42 of transparent synthetic resin. The case 42 has an opening portion in its top portion so that the thermally color-changeable article can be put into and taken out desirably, and cool air from the communication path 6 can be taken in. A plurality of holes are provided at the bottom of the case 42 so as to enable air to flow, and the bottom forms the mount portion 41 on which the thermally color-changeable article 2 can be mounted. The case 42 has a shape like a drawer, so that when a handle in the front of the case 42 is drawn to this side, and the thermally color-changeable article 2 can be put into and taken out through the opening portion. In addition, the inside of the air cooling chamber 4 can be seen through the front side of the transparent case 42. That is, a see-through portion 43 is formed in the front side of the case 42.

The communication path 6 is an air flow space which makes the opening portion in the top of the air cooling chamber 4 communicate with the communication holes 51 of the cooling source chamber 5. An air blower 7 is provided inside the communication path 6. A motor-driven fan is employed as the air blower 7 similarly to the first embodiment. With the operation of the motor-driven fan, the air in the body 31 is circulated, as indicated by arrows in FIG. 3, in the order from the communication path 6 (the air blower 7)→the air cooling chamber 4→the mount portion 41→the liquid collecting portion 8→the communication holes 52→the cooling source chamber 5→the communication holes 51→the communication path 6.

(Embodiment 3)

Figure 4:
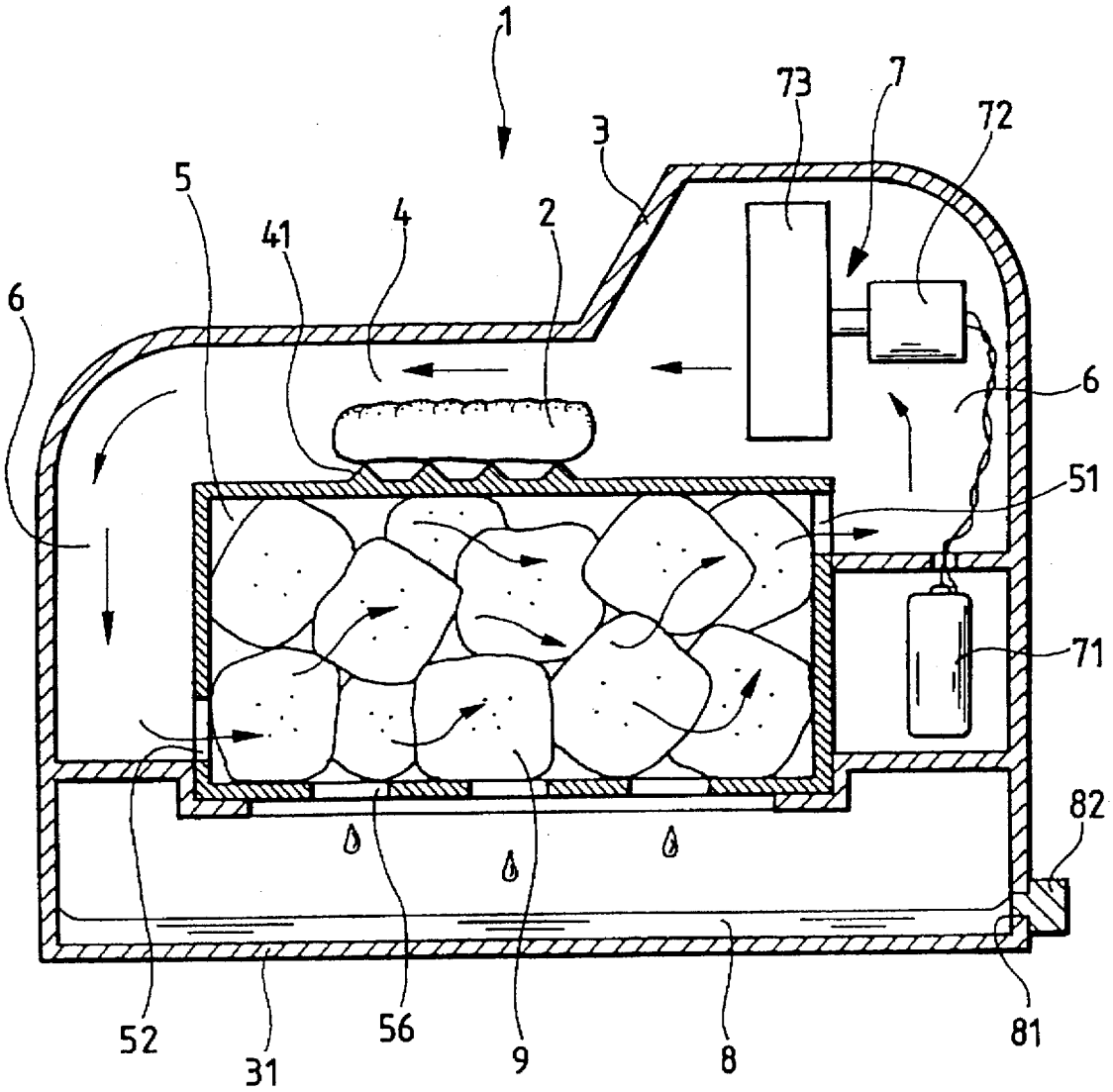
FIG. 4 is a vertical sectional view of a third embodiment of the present invention.

A third embodiment according to the present invention will be described with reference to FIG. 4. In the drawings, reference numeral 1 represents a thermally color-changeable toy. In a color changing device 3, a cooling source chamber 5 is stored in a body 31 of a transparent plastic material, a communication path 6 is formed in the upper outer circumferential surface of the cooling source chamber 5, and an air cooling chamber 4 and an air blower 7 are provided in the communication path 6 in the same manner as in the first embodiment.

The cooling source chamber 5 is a rectangular vessel of metal. In the cooling source chamber 5, a communication hole 52 is provided in the lower portion on one side while a communication hole 51 is provided in the upper portion on the opposite side. Consequently, air flows from the lower portion to the upper portion in the cooling source chamber 5, so that the air passes among a plurality of cool blocks 9 (herein ice lumps) stored so as to be piled up in the inside of the cooling source chamber 5 to thereby obtain the cool energy of the cool blocks 9 effectively. The communication holes 51 and 52 are connected to each other through the communication path 6 formed in the outside wall of the cooling source chamber 5. Further, since the cooling source chamber 5 of metal has a high thermal conductivity, the air flowing in the communication path 6 which contacts with the outside wall of the cooling source chamber 5 is cooled more and more.

The top surface of the cooling source chamber 5 forms a mounting portion 41 for mount a thermally color-changeable article 2 (herein, food imitating bread, sausage, hamburg steak or the like). Since the surface of the mount portion 41 is made rough and made of metal, it is possible to give a rough pattern to the thermally color-changeable article 2 by heat conduction from the cool blocks 9. There is a further effect to prevent the thermally color-changeable article 2 from slipping or moving due to contact with the flowing air.

In addition, a liquid collecting portion 8 is provided under the cooling source chamber 5 in the same manner as in the first and second embodiments. The liquid collecting portion 8 communicates with the cooling source chamber 5 through holes 56 provided in the bottom of the cooling source chamber 5, so that water drops fall down from the cool blocks 9 through the holes 56.

(Embodiment 4)

Figure 5:
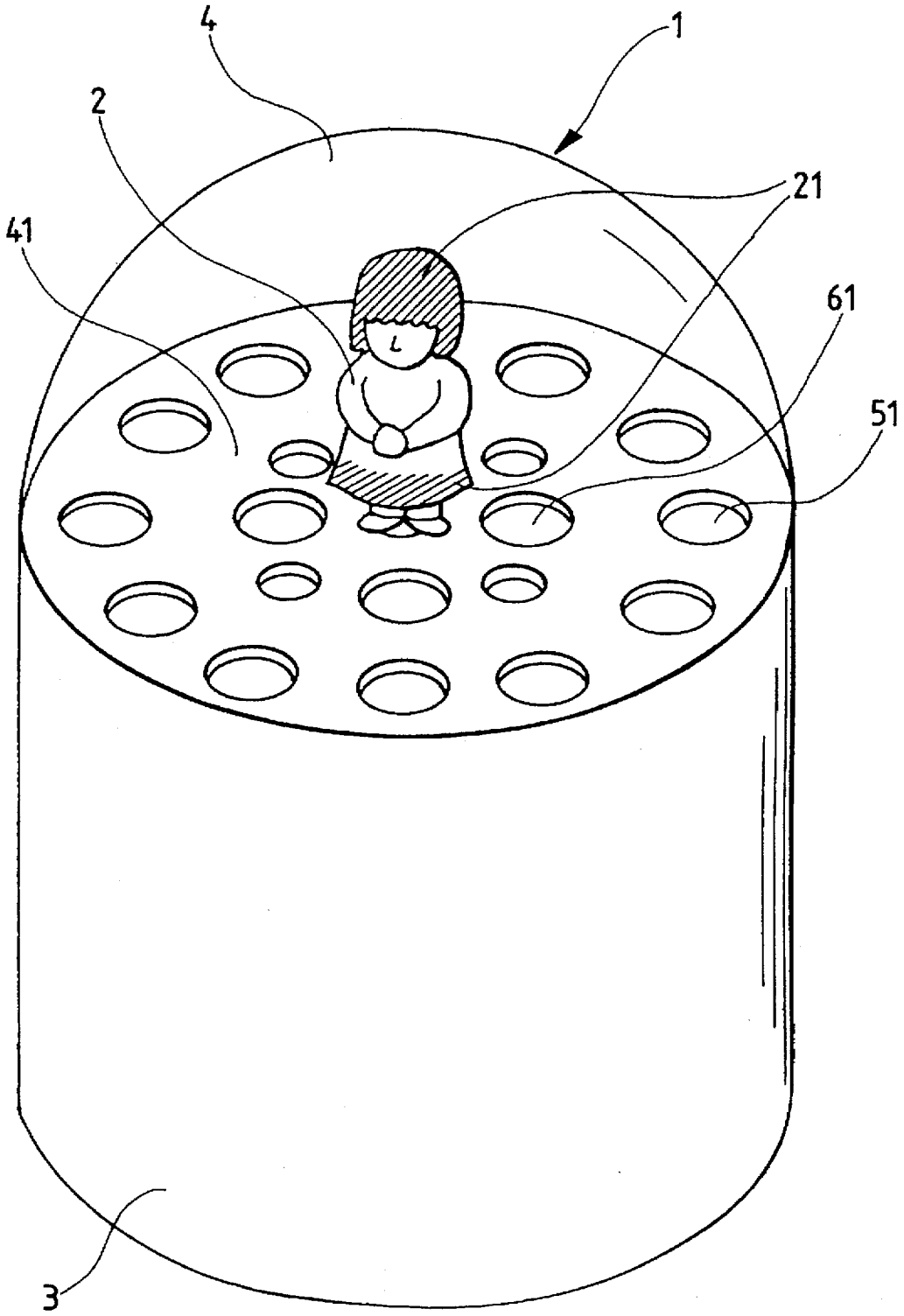
FIG. 5 is a perspective view of a fourth embodiment of the present invention.
Figure 6:
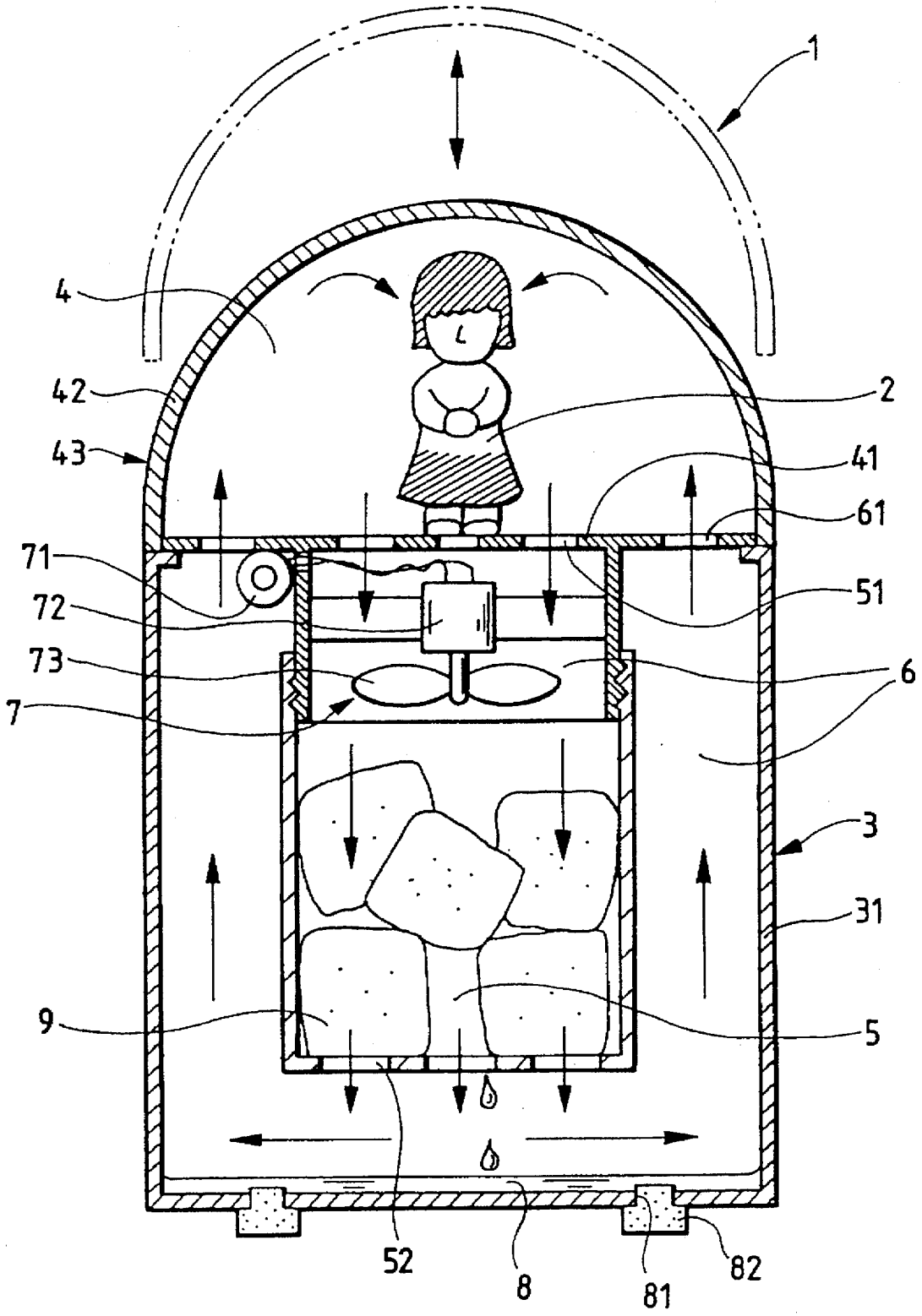
FIG. 6 is a vertical sectional view of FIG. 5.

A fourth embodiment according to the present invention will be described with reference to FIGS. 5 and 6. In the drawings, reference numeral 1 represents a thermally color-changeable toy. A color changing device 3 is constituted by a domed air cooling chamber 4 the whole circumference of which is transparent, and a cylindrical body 31 with the air cooling chamber 4 formed on its top portion. The air cooling chamber 4 is constituted by a transparent hemispheric case 42, and is disposed detachably on a mount portion 41 on the top portion of the body 31. As a thermally color-changeable article 2, a doll is used in which reversibly and thermally color-changeable portions 21 are provided in the form of hair and clothing of the doll.

A disc-like mount portion 41 penetrated by a plurality of communication holes 51 and 61 is formed on the top of the body 31. A cylindrical communication path 6 provided inside with an air blower 7 in the same manner as in the first embodiment is provided to project at the center of the lower surface of the mount portion 41. Further, a cooling source chamber 5 storing cool blocks 9 piled up in its inside is connected to the lower portion of the communication path 6. That is, the air blower 7 and the cooling source chamber 5 are connected to each other vertically.

In addition, the communication path 6 is formed in a gap between the outside wall of the cooling source chamber 5 and the inside wall of the body 31. The communication holes 61 of the air cooling chamber 4 and communication holes 52 of the cooling source chamber 5 are connected to each other through the communication path 6. In addition, the communication holes 51 of the air cooling chamber 4 and the cooling source chamber 5 are connected to each other through the communication path 6 having the air blower 7.

A liquid collecting portion 8 is provided under the cooling source chamber 5 in the body 31. The liquid collecting portion 8 communicates with the cooling source chamber 5 through the communication holes 52 provided in the bottom of the cooling source chamber 5 so that water drops fall down from the cool blocks 9 into the liquid collecting portion 8 through the communication holes 52. In addition, exhaust ports 81 are provided in the bottom of the liquid collecting portion 8, and stoppers 82 are detachably attached to the exhaust ports 81.

(Embodiment 5)

Figure 7:
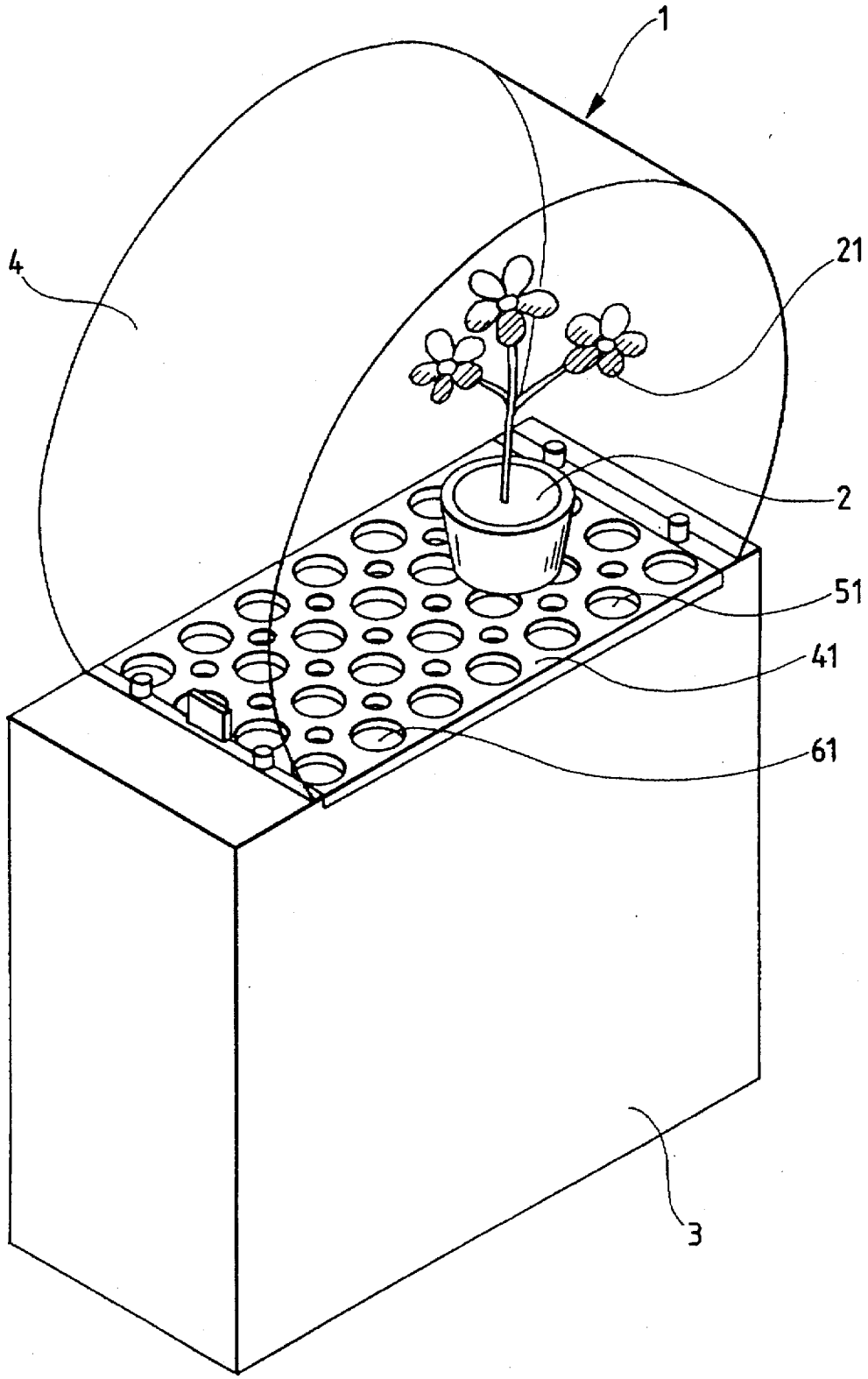
FIG. 7 is a perspective view of a fifth embodiment of the present invention.
Figure 8:
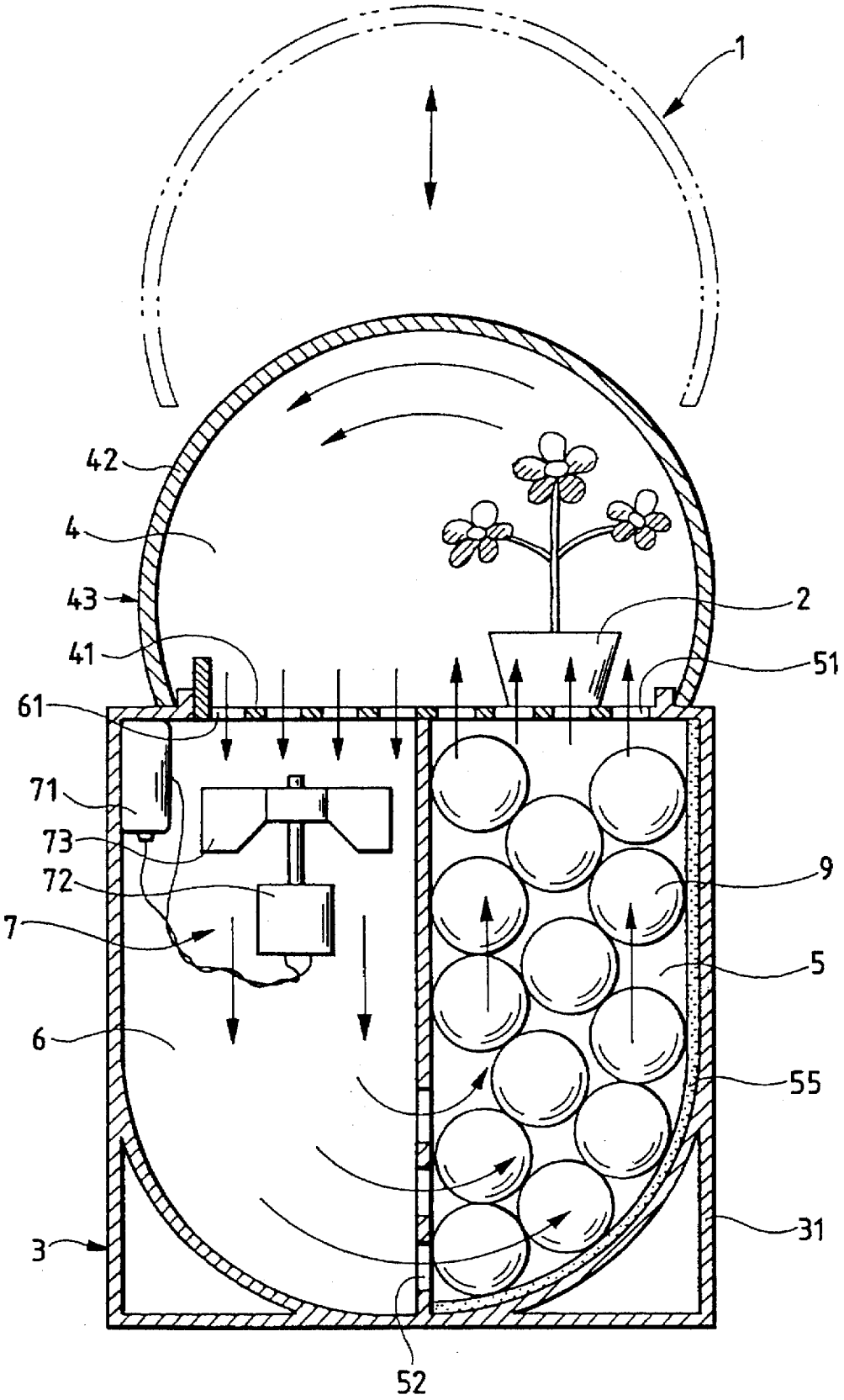
FIG. 8 is a vertical sectional view of FIG. 7.

A fifth embodiment according to the present invention will be described with reference to FIGS. 7 and 8.

In the drawings, reference numeral 1 represents a thermally color-changeable toy. As the thermally color-changeable article 2, used is an artificial flower having a reversibly and thermally color-changeable portion 21. A color changing device 3 is constituted by an air cooling chamber 4 constituted by a detachable case the whole circumference of which is transparent, and a rectangular body 31 with the air cooling chamber 4 provided on its top portion.

A plate-like mount portion 41 penetrated by a plurality of communication holes 51 and 61 is provided on the top portion of the body 31. A communication path 6 having therein an air blower 7 in the same manner as in the first embodiment, and a cooling source chamber 5 storing therein cool blocks 9 (a plurality of ball-like cool-accumulation blocks) are disposed in parallel to each other under the mount portion 41. The cooling source chamber 5 is made to communicate with the communication path 6 through communication holes 52 provided in the lower portions of a partition between the cooling source chamber 5 and the communication path 6. In addition, the air cooling chamber 4 communicates with the cooling source chamber 5 through the communication holes 51 of the mount portion 41, and communicates with the communication path 6 through the communication holes 61 of the mount portion 41.

(Embodiment 6)

Figure 9:
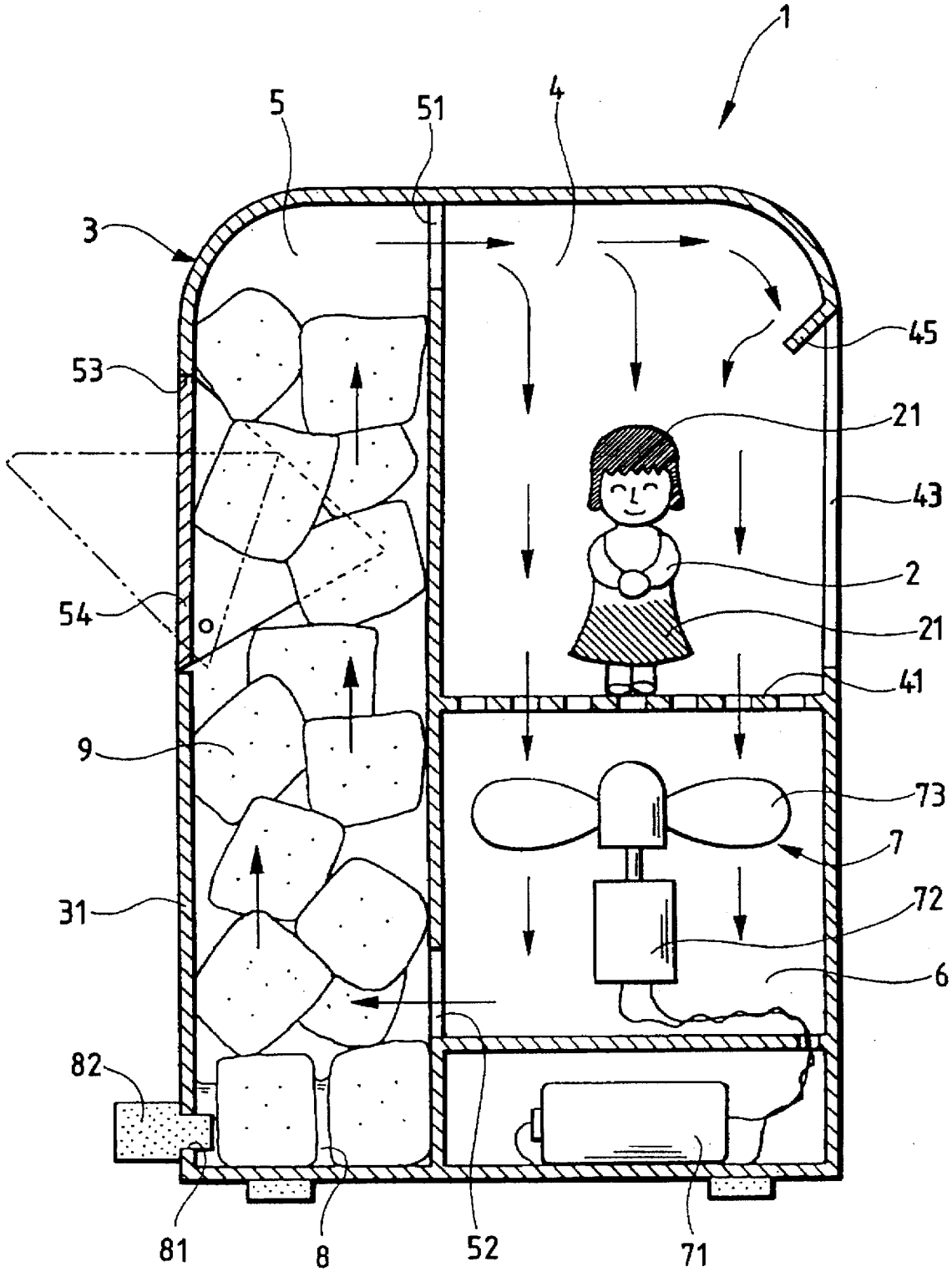
FIG. 9 is a vertical sectional view of a sixth embodiment of the present invention.

A sixth embodiment according to the present invention will be described with reference to FIG. 9. In the drawings, reference numeral 1 represents a thermally color-changeable toy.

This is a modification of the first embodiment. Excepting a difference from the first embodiment only in the structure of the air cooling chamber 4, the sixth embodiment is the same in structure as the first embodiment.

An opening portion 43 which serves as a see-through portion is provided in the front side of the air cooling chamber 4. An air current changing plate 45 is provided at the upper end of the opening portion 43 so as to project toward the inside of the air cooling chamber 4. Consequently, air blowing out from a communication hole 51 contacts with the current plate 45 so as to be restricted downward. It is, therefore, possible to prevent cool air from leaking out from the opening portion 43 to the outside as much as possible so that the cool air can cool the air circulated in the color changing device 3 sufficiently. Thus, it is possible to prevent the cooling efficiency from being reduced due to the leakage of the air. In addition, the opening portion 43 functions also as a port for putting-into/taking-out a thermally color-changeable article 2 (herein a doll), so that the labor to open and close the air cooling chamber 4 as in the first to fifth embodiments is unnecessary. Thus, it is possible to put into and take out the thermally color-changeable article 2 rapidly.

What is claimed is:

1. A thermally color-changeable toy comprising:

a thermally color-changeable article, at least part of a surface of said article being changed by cool air; and a color-changing device for changing a color of said thermally color-changeable article, said color-changing device comprising:

a cooling source chamber for storing a plurality of cool blocks;

an air cooling chamber for storing said thermally color-changeable article, said air cooling chamber communicating with said cooling source chamber to circulate cool air; and an air blowing means for blowing cool air, said air blowing means being disposed in a communication path between said cooling source chamber and said air cooling chamber;

wherein said cool blocks are stored in a piled-up state in said cooling source chamber so that air flow gaps are formed among said cool blocks, said color-changing device further comprising:

a first communication hole provided in an upper portion of said cooling source chamber; and a second communication hole provided in a lower portion of said cooling source chamber;

wherein said cooling source chamber and said air cooling chamber are communicated with each other through said first and second communication holes so as to circulate air, the air being made to flow upward or downward in said cooling source chamber.

2. A thermally color-changeable toy according to claim 1, further comprising a liquid collecting portion provided under said second communication hole.

3. A thermally color-changeable toy according to claim 1, further comprising a see-through portion for seeing an inside of said air cooling chamber from an outside.

4. A thermally color-changeable toy according to claim 3, further comprising a case for covering said air cooling chamber from the outside, said case constituting said see-through portion.

5. A thermally color-changeable toy according to claim 3, further comprising an air current changing device for preventing cool air from leaking out from said air cool chamber.

6. A thermally color-changeable toy according to claim 1, wherein the volume of said cooling source chamber is not less than 1/20 of the volume of air circulation space except said cooling source chamber.

7. A thermally color-changeable toy according to claim 1, wherein said thermally color-changeable article is an imitation food.

8. A thermally color-changeable toy according to claim 1, wherein said thermally color-changing device is an imitation kitchen appliance.

9. A thermally color-changeable toy according to claim 1, wherein said thermally color-changeable article is a doll.

10. A thermally color-changeable toy according to claim 1, wherein said cool blocks are stored in said cooling source chamber to be plied up in random while contacting with each other.

11. A thermally color-changeable toy comprising:

a thermally color-changeable article, at least part of a surface of said article being changed by cool air; and a color-changing device for changing a color of said thermally color-changeable article, said color-changing device comprising:

a cooling source chamber for storing a plurality of cool blocks and including an upper portion and a lower portion, said cooling source chamber having a first communication hole provided in said upper portion and a second communication hole provided in said lower portion, said cool blocks being stored in a piled-up state in said cooling source chamber so that air flow gaps are formed among said cool blocks;

an air cooling chamber for storing said thermally color-changeable article, said air cooling chamber communicating with said cooling source chamber through said first and second communication holes to circulate cool air; and an air blower which blows cool air, said air blower being disposed in a communication path between said cooling source chamber and said air cooling chamber;

wherein the air flows in said cooling source chamber from one of said first and second communication holes to the other of said first and second communication holes and passes among said cool blocks.

* * * * *